United States Patent [19]

Tresh

[11] Patent Number: 4,887,811

[45] Date of Patent: Dec. 19, 1989

[54] BASEBALL SLIDE PRACTICE DEVICE

[76] Inventor: Thomas M. Tresh, 4256 E. Wing, Mt. Pleasant, Mich. 48858

[21] Appl. No.: 297,177

[22] Filed: Jan. 13, 1989

[51] Int. Cl.[4] ..... A63G 21/04

[52] U.S. Cl. ..... 272/56.5 R; 273/25

[58] Field of Search ..... 272/56.5 R, 56.5 SS, 272/1 B, 1 R, 101; 273/25; 5/482, 484, 487, 495, 496, 497, 500; 182/48, 138

[56] References Cited

U.S. PATENT DOCUMENTS

| | | | |
|---|---|---|---|
| 2,982,547 | 5/1961 | Carrier . | |
| 3,181,863 | 5/1965 | Nellermoe | 273/25 |
| 3,242,509 | 3/1966 | Nissen . | |
| 3,262,134 | 7/1966 | Bramble, Jr. . | |
| 3,291,486 | 12/1966 | Applegath et al. | 272/56.5 SS |
| 3,518,707 | 7/1970 | Nissen . | |
| 3,654,646 | 4/1972 | McMahon | 5/482 X |
| 3,715,120 | 2/1973 | Peltola | 272/56.5 R |
| 3,892,401 | 7/1975 | Sorenson . | |
| 3,892,402 | 7/1975 | Montour et al. . | |
| 4,137,583 | 2/1979 | Baldwin et al. . | |
| 4,168,061 | 9/1979 | Gordon . | |
| 4,350,721 | 9/1982 | Nagase . | |
| 4,574,101 | 3/1986 | Tricca et al. . | |
| 4,762,316 | 3/1988 | Merino . | |

OTHER PUBLICATIONS

D. W. Gordon, Inc., 1977 Landing Pit Catalog, ©1977, p. 6.

*Primary Examiner*—Richard E. Chilcot, Jr.
*Attorney, Agent, or Firm*—Price, Heneveld, Cooper, De Witt & Litton

[57] ABSTRACT

A device for use in practicing baseball sliding techniques includes an elongated pad having an upper surface and a lower, ground engaging surface. The pad includes a shock absorbing or cushioning material enclosed within a fabric covering. An elongated fabric sheet overlies the pad. The sheet has a lower end secured to the pad. The majority of the overlying sheet is movable horizontally on the upper surface of the pad. A user can land on the sheet and slide along with the sheet over the upper surface of the pad. The pad and sheet absorb impact and eliminate or reduce sliding friction.

13 Claims, 2 Drawing Sheets

BASEBALL SLIDE PRACTICE DEVICE

BACKGROUND OF THE INVENTION

The present invention relates to athletic training devices and more particularly to a unique device for practicing baseball sliding techniques.

While playing baseball, many instances will arise where the base runner should slide into base or home plate. Depending upon the situation, various sliding techniques may be used, including the hook slide and the head first slide. Heretofore, there has been no satisfactory way to practice the sliding techniques. Baseball players could practice on the field or on simulated base paths set up only for sliding practice. By its very nature, however, sliding can cause injury. The player can be bruised due to the impact with the ground. In addition, abrasion due to sliding contact with the ground is fairly common. As a result, practicing sliding techniques increases the possibility of injury. Due to such inherent problems, players have avoided or resisted slide practice. Lack of practice results in poor technique which increases the possibility of injury in a game situation.

A need, therefore, exists for a practice or training device which will permit a player to practice the various sliding techniques while significantly eliminating the causes of and hence reducing the chance for injury.

SUMMARY OF THE INVENTION

In accordance with the present invention, the aforementioned needs are fulfilled. Essentially, a device is provided which includes an elongated cushion or pad having an upper surface and a lower ground engaging surface. An elongated, horizontally movable sheet overlies the cushion. The sheet is secured to the cushion only at a lower portion thereof. In use, a user lands and slides on the upper surface of the sheet and pad. The pad cushions or absorbs the impact with the ground and the elongated sheet slides along the upper surface of the pad. The sheet substantially reduces or eliminates sliding contact between the user and the pad. Bruises and abrasions are substantially reduced or eliminated. Repeated practice slides may be had without injury. Using the device, a ball player can safely master the various baseball slide techniques.

DETAILED DESCRIPTION OF THE PREFERRED EMBODIMENT

Figure 1:
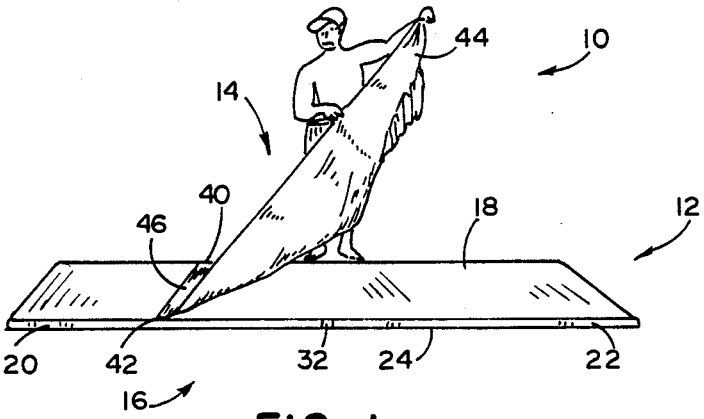
FIG. 1 is a side, perspective view of a baseball slide practice device in accordance with the present invention.
Figure 2:
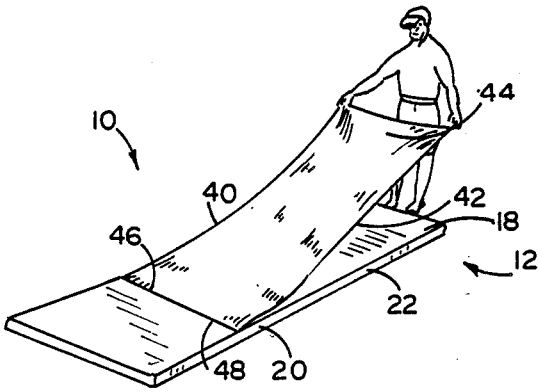
FIG. 2 is an end, perspective view of the slide practice device.
Figure 6:
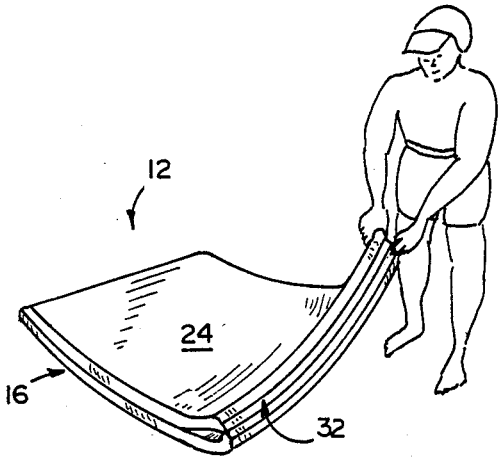
FIG. 6 is an end, elevational view showing the pad folded over for storage purposes.
Figure 7:
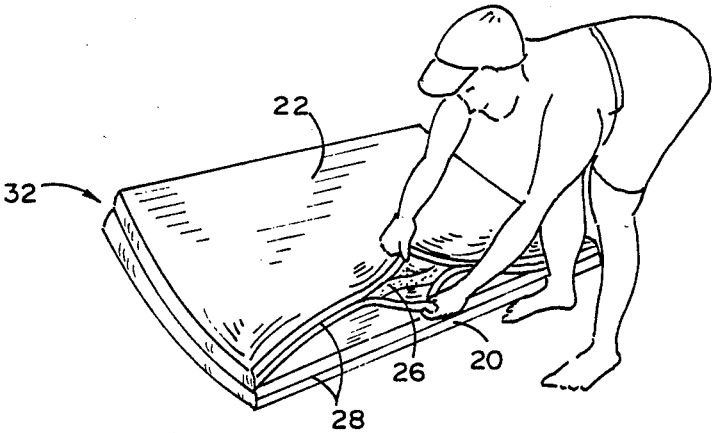
FIG. 7 is a side, elevational view showing the manner by which the pad may be opened to obtain access to an inner cushion.

A preferred embodiment of a baseball slide practice device in accordance with the present invention is illustrated in FIGS. 1 and 2 and generally designated by the numeral 10. Device 10 includes an elongated pad or mat 12 and an overlying slide sheet 14. Pad 12, as seen in FIGS. 1, 6 and 7, includes an outer fabric covering or envelope 16. Covering 16 has a single piece or continuous upper sheet 18 and pockets 20, 22. Each pocket 22 defines a ground engaging surface 24. In the form illustrated, each pocket 20, 22 encloses a cushion formed from a dense rubbery material A single cushion is shown in FIG. 7 and designated by the numeral 26. The cushion is formed from any of the presently available dense rubbery athletic pads, such as those made from polyethylene foam or PVC/nitrile foam. One such material is a PVC/nitrile closed-cell, cross-linked polymer sold under the brand name ENSOLITE-HH by Uniroyal Such foam is sold in 48 inch×68 inch sheets or in rolls and has a density of 10.50 lbs./ft.$^3$ For cost reasons, it is presently preferred that the cushion be formed from a less expensive dense foam which can be rolled for storage purposes. One such material is sold under the designation GB700 by Foam Engineering, Grand Rapids, Mich. The specific foam used is not critical. One should be selected which absorbs the normal sliding impact. The pad need not be as dense as that used with wrestling mats, for example.

Pockets 20, 22 are openable along lateral edges 28. The lateral edges may be zippered or slit and joined with hook and loop fasteners. The pockets can be opened for removal and insertion of the foam cushions. The fabric covering the foam cushions is preferably air permeable so that air may breath in and out upon impact and recovery. A breathable fabric heretofore used for athletic mats is made from nylon fibers coated with polyvinylchloride. Such fabric material is breathable and resistant to abrasion. The nylon fabric is a self-lubricating material which reduces friction on upper surface or sheet 18.

As seen in FIGS. 1 and 6, when fully extended, the pockets 20, 22 will abut at a junction 32. As shown in FIG. 6, the abutting faces of the pockets along junction 32 may be joined together with a suitable hook and loop fastener material The hook portion may be on one face and the loop portion may be on the other face. The pad is readily foldable at junction 32 for storage purposes. When extended for use, however, the pockets are in effect joined together to define a single pad or mat.

Figure 4:
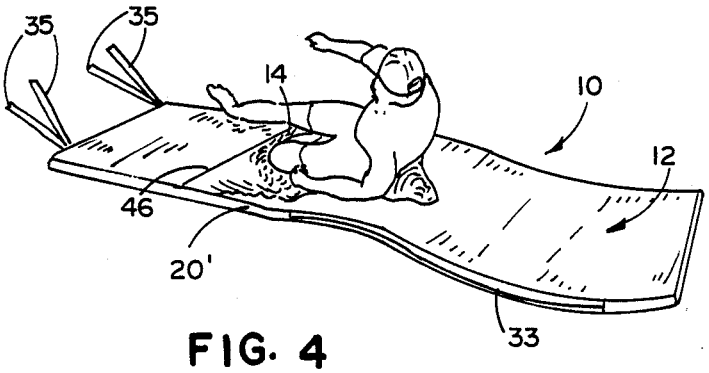

An alternative and presently preferred form is illustrated in FIG. 4. As shown, mat 12 has a single pocket 20'. A lateral edge of pocket 20' is closed by an elongated zipper 33. A single cushion or two cushion sections which are joined together are placed in the pocket. In an existing embodiment, the cushion is twelve feet in length. The zippered opening is approximately five feet in length. The pad is selected for cushioning protection. It is preferred that the density be such that it is rollable. The device may also include nylon straps 35 (FIG. 4). When rolled, straps 35 are tied around the roll in the same manner as a sleeping bag.

As best seen in FIGS. 1 and 2, overlying or slide sheet 14 is elongated and has substantially the same width dimension as pad 12. Sheet 14 includes lateral edges 40, 42 and upper free end portion 44 and a lower edge 46. Edge 46 is joined to upper sheet 18 of pad covering 16. Sheet 14 may be joined to the surface by suitable stitching 48 across lateral edges 40, 42 and edge 46 (FIG. 2). It is presently preferred that sheet 14 be joined to pad 12 at approximately the lower quarter portion of the pad. Sheet 14 has a length approximately three-fourths the length of pad 12. Slide sheet 14, as with cover 16, may be made from nylon fibers coated with polyvinylchloride. In the alternative, sheet 14 may have substantially the same length as pad 12 and be joined at the end of the pad. The spacing of edge 48 and the end of the pad is presently preferred so that there is a space for sheet 14 to collect when the device is used. Also, sheet 14 may be formed from two or more sheets to increase resistance to wear.

Figure 3:
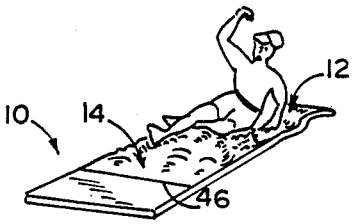
FIGS. 3–5 are perspective views showing the manner of use of the device in accordance with the present invention.
Figure 5:
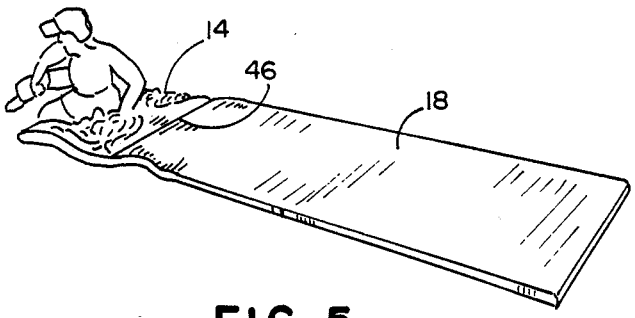

In use, a player will initially position elongated sheet 14 so that it completely overlies pad 12. The player will approach the pad at upper end 44 of the sheet. As shown in FIG. 3, the user will initiate a slide by landing on the upper or free end portion of the sheet. The underlying pad 12 absorbs the impact of the initial landing. As shown in FIGS. 4 and 5, the user slides along upper surface or sheet 18 of pad 12. Slide sheet 14 is interposed between the user and the upper surface of the pad. The user, therefore, does not make direct sliding contact with pad 12 or with the ground surface.

The device eliminates or substantially reduces frictional contact and hence the risk of abrasion. The cushion absorbs initial impact. This reduces bruising. A ball player may, therefore, practice repeated slides to improve technique while substantially reducing or completely eliminating the risk of injury. Making the slide sheet and covering from nylon fabric improves wear and longevity. Nylon is a self-lubricating material which reduces wear from abrasion between the sheet and the pad covering. A vinyl covered nylon resists abrasion, scuffing and cutting.

The sliding practice device in accordance with the present invention may be used indoors or outdoors. The device, therefore, promotes and permits practice of sliding techniques during the off season. The need for special slide practice areas is eliminated. The device is readily foldable or rolled for storage purposes In view of the foregoing description, those of ordinary skill in the art may envision various modifications which would not depart from the inventive concepts disclosed. For example, a single elongated cushion or a plurality of cushions could be used. In addition, fabric other than that formed from a nylon fiber, such as canvas or the like, could be used. Such fabrics would not, however, be expected to provide the same life expectancy. Therefore, it should be understood that the above description should be considered as only that of the preferred embodiment. The true spirit and scope of the present invention may be determined by reference to the appended claims.

The embodiments of the invention in which an exclusive property or privilege is claimed are defined as follows:

1. A device for use in practicing baseball sliding techniques, said device comprising:

an elongated pad including cushioning material enclosed within a fabric covering; and an elongated fabric sheet having a lower portion and an upper portion, said sheet overlying said pad and having a width substantially equal to the width of and a length substantially equal to the length of said pad, said sheet being secrued to said pad only at said lower portion thereof with said upper portion being free and with said pad underlying all of said sheet so that a user can land on said upper portion of said sheet and slide on said sheet and the sheet will move freely horizontally along the length of said pad.

2. A device as defined by claim 1 wherein said fabric sheet is made from nylon.

3. A device as defined by claim 1 wherein said pad includes at least a pair of elongated, generally rectangular cushions and said fabric covering includes a continuous top sheet extending across said cushions.

4. A device as defined by claim 3 wherein said fabric covering defines a pair of pockets for receiving said cushions

5. A device as defined by claim 1 wherein said cushions are formed from a dense foam rubber.

6. A device as defined by claim 5 wherein said fabric sheet is made from nylon.

7. A slide practice device for use by baseball players, said device comprising:

an elongated cushion having an upper surface and a ground engaging lower surface, said cushion further including an upper portion and a lower portion; and an elongated horizontally movable member having an upper surface and lower surface, said member having a width substantially equal to the width of said cushion and a length so that said cushion underlies said member with said lower surface of said member overlying said upper portion of said cushion and means engaging said member for connecting said member for movement along said upper surface from said upper portion to said lower portion of said cushion whereby a user can land on said upper surface of said member and slide freely with the member along substantially the entire length of said cushion.

8. A slide practice device as defined by claim 7 wherein said elongated cushion includes:

a shock absorbing pad formed from a closed-cell, cross-linked polymer; and a fabric covering enclosing said pad.

9. A slide practice device as defined by claim 7 wherein said member is an elongated, flexible slide sheet having only a lower end joined to said cushion, said sheet having an upper free end.

10. A slide practice device as defined by claim 9 wherein said elongated cushion includes:

a pad formed from a dense rubbery material; and a fabric covering enclosing said pad.

11. A slide practice device as defined by claim 10 wherein said fabric covering is made from a nylon fabric.

12. A slide practice device as defined by claim 9 wherein said slide sheet is formed from a nylon fabric.

13. A slide practice device as defined by claim 11 wherein said slide sheet is formed from a nylon fabric.

* * * * *